United States Patent [19]

Elieli

[11] Patent Number: 4,965,839

[45] Date of Patent: Oct. 23, 1990

[54] ELECTRO ACOUSTIC TRANSDUCER AND LOUDSPEAKER

[76] Inventor: Boaz Elieli, 6, Patricia Close, West End, Southampton, Hampshire, SO3 3SP, England

[21] Appl. No.: 360,374

[22] Filed: Jun. 2, 1989

[30] Foreign Application Priority Data

Jun. 2, 1988 [GB] United Kingdom ..... 8813001
Jan. 27, 1989 [GB] United Kingdom ..... 8901786

[51] Int. Cl.[5] ..... H04R 9/00

[52] U.S. Cl. ..... 381/195; 381/184; 381/186; 381/192

[58] Field of Search ..... 381/192, 194, 199, 201, 381/202, 182, 184, 185, 186, 195

[56] References Cited

U.S. PATENT DOCUMENTS 4,525,604 6/1985 Frye ..... 381/156
4,547,632 10/1985 Bryson ..... 381/199

FOREIGN PATENT DOCUMENTS 0545712 6/1942 United Kingdom ..... 381/186
2118398 4/1982 United Kingdom .

*Primary Examiner*—Jin F. Ng
*Assistant Examiner*—M. Nelson McGeary, III
*Attorney, Agent, or Firm*—Gottlieb, Rackman & Reisman

[57] ABSTRACT

A loudspeaker transducer has a coil (5) and a metal dome (11) with a skirt (13) arranged concentrically in a magnetic gap between pol pieces (2 and 4). The skirt (13) is inductively coupled to the coil (5) but is mechanically independent of the coil former tube (6). The tube (6) is connected to a main low frequency cone (9) and to a short concentric additional cone (16). A fixed element (14) providing phase correction and/or horn loading is fixed to the center pole piece (4) in front of the dome (11) and within the tube (6). The member (14) and tube (6) co-operate acoustically.

11 Claims, 4 Drawing Sheets

ELECTRO ACOUSTIC TRANSDUCER AND LOUDSPEAKER

The invention relates to an electro acoustic transducer, for instance for use in a loudspeaker or audio frequency sound reproduction device, and to a loudspeaker or audio frequency sound reproduction device incorporating such a transducer.

In an inductively coupled system of the type shown in GB No. 545712 and GB No. 2118398, a moving coil electro acoustic transducer comprises a coil which drives a radiation surface. The coil, which is free to oscillate, is located within a magnetic gap. A shorted turn for driving a radiating dome is located within the coil and in the same magnetic gap. The shorted turn is mechanically independent of the coil and is inductively coupled to the coil.

"Mechanically independent" means that, except for residual transfer of momentum between the coil and the shorted turn, for instance passed through the air or any other intervening fluid which lies in the gap between the coil and the shorted turn, there is no coupling of momentum between the coil and the shorted turn.

The shorted turn and the radiating dome may be an integral component in the form of a thin cylindrical cup made out of any suitable electrically conductive material, generally metal. The thin cylindrical cup, which will be referred to as a shorted turn dome, is suspended on a magnet assembly pole piece by suspension means.

In operation, when an electrical signal is applied to the coil via its input terminals, the shorted turn receives electrical energising signals exclusively from the coil by means of electrical transformer action. The transformer action provides a high pass filter coupling to the shorted turn.

The resulting acoustic output of the inductively driven shorted turn dome in such a system contains some anomalies and irregularities which are caused by the shorted turn dome acoustically radiating through the coil former tube and by the acoustic impedance discontinuity at the end of the coil former tube. These acoustic output anomalies are the direct result of the system geometry and physical location of the shorted turn dome inside the coil former tube. Although the extent of the resulting adverse effect may be marginally reduced with a well-optimised design, the overall control of the shorted turn dome acoustic output is limited and inadequate for many applications, especially in high-fidelity sound reproducing systems. According to a first aspect of the ,invention, there is provided an electro acoustic transducer in which a fixed member and the coil former (and, where present, the flared extension) substantially reduce or eliminate acoustic output anomalies and irregularities of the shorted turn dome, while at the same time providing additional means for controlling the acoustic output, for instance by permitting adjustment of the frequency bandwidth, output level, and directivity characteristics, of the inductively driven shorted turn dome. The fixed member provides a uniform, efficient, and controllable transfer of acoustic energy from the surface of the radiating dome through the coil former tube. The fixed member may be of various shapes and configurations and the inner surface of the coil former tube cooperates with the fixed member acoustically.

The inclusion of the flared extension provides part of the horn loading of the shorted dome and reduces the adverse effect on the acoustic output caused by the acoustic impedance discontinuity at the end of the coil former tube.

The invention will be further described, by way of example, with reference to the accompanying drawings, in which.

Figure 3:
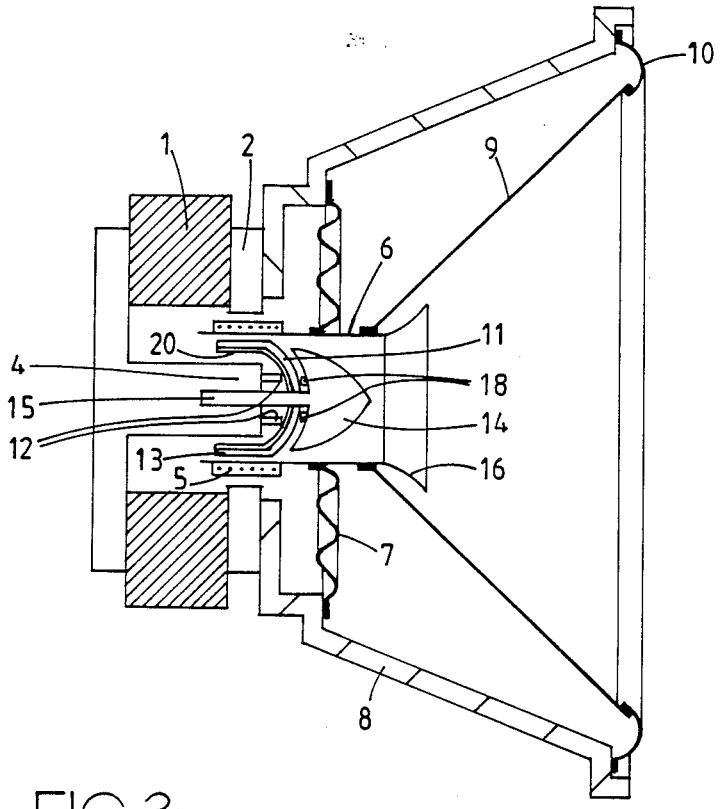
FIG. 3 is a cross-sectional view of an inductively coupled electro acoustic transducer constituting a preferred embodiment of the invention.
Figure 5A:
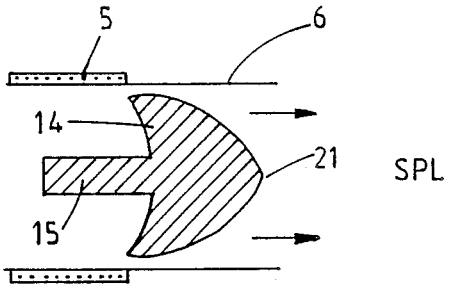
Figure 5B:
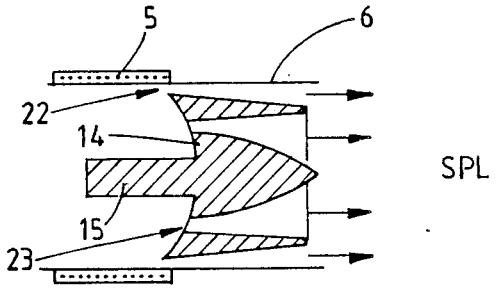
Figure 5C:
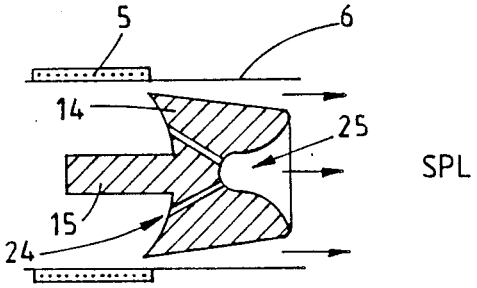
Figure 5D:
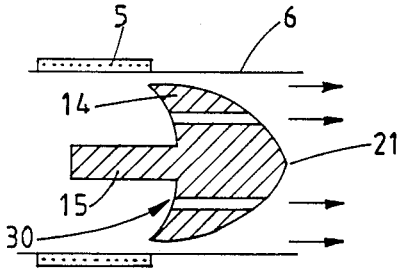
Figure 5E:
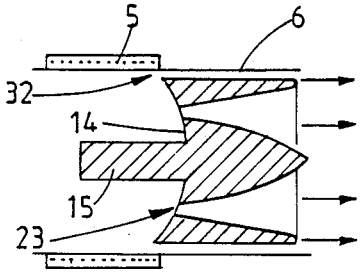
Figure 6:
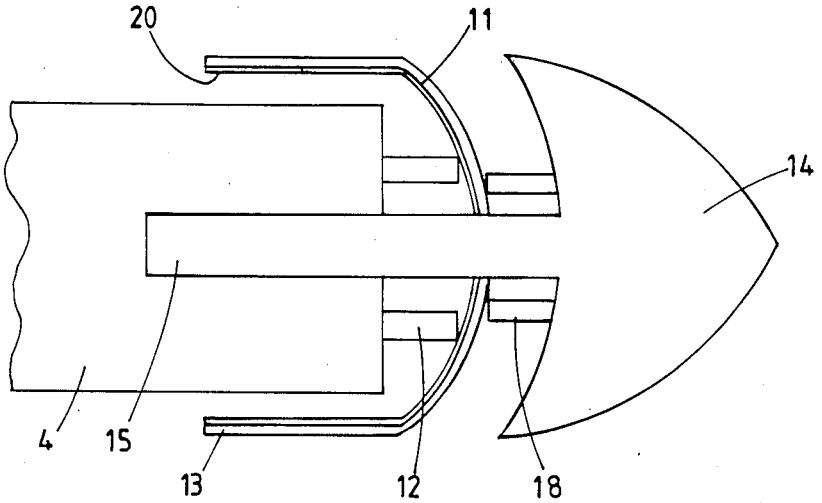

FIGS. 5*a*–5*e* show cross-sections of various forms of fixed member for the transducer of FIG. 3; and FIG. 6 shows a detail of the transducer of FIG. 3 to an enlarged scale.

Figure 1:
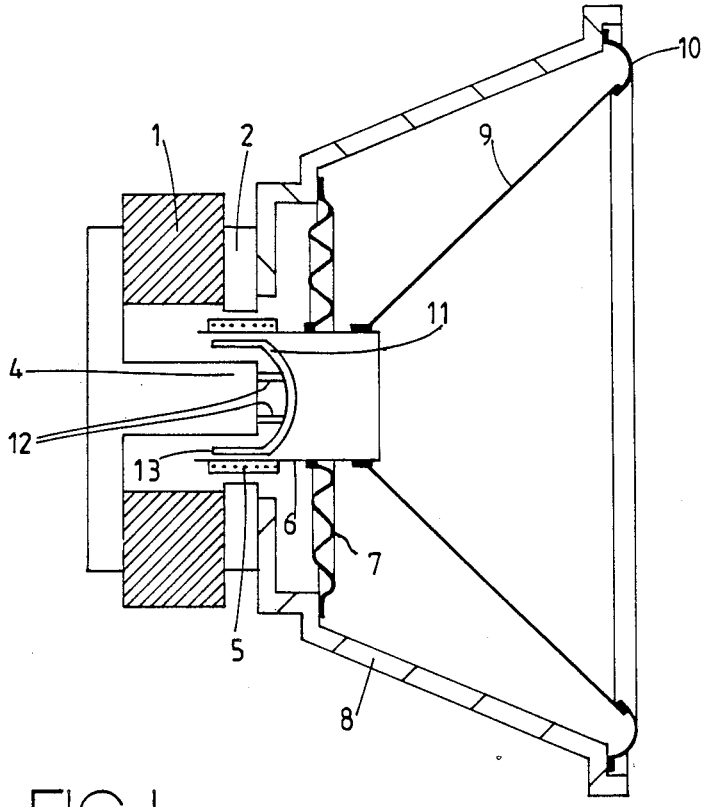
FIG. 1. PRIOR ART
FIG. 1 is a cross-sectional view of a known type of inductively coupled electro acoustic transducer.

The transducer shown in FIG. 1 is a loudspeaker drive unit for use in a sound reproduction loudspeaker system. The transducer comprises a permanent magnet 1 provided with an annular pole piece 2 and a centre pole piece 4 defining therebetween a magnetic gap. The gap may be an air gap or may contain ferrofluid. A coil 5 is located in the magnetic gap and is wound on a coil former tube 6 which is properly located by a suspension 7 attached to a chassis 8. The forward end of the coil former tube 6 is connected to the center of an acoustic radiating cone 9 whose outer edge is connected to the chassis 8 by a roll surround 10.

A metal dome 11 is suspended on the pole piece 4 by a suspension 12 and has a skirt 13 which extends into the magnetic gap inside the coil 5 and the former tube 6.

The cone 9 driven by the coil 5 provides acoustic output at relatively low frequencies whereas the dome 11 provides acoustic output at relatively high frequencies. The skirt 13 of the dome 11 acts as a shorted turn secondary winding of a transformer whose primary winding is provided by the coil 5. Thus, a signal to be reproduced is supplied to the coil 5 and drives both the cone 9 and the dome 11. The transformer action provides a high pass filtering action and, by appropriate design of the various parts of the transducer, a concentric two-way drive unit is provided without the need for an external crossover filter for dividing the frequency range.

Figure 2:
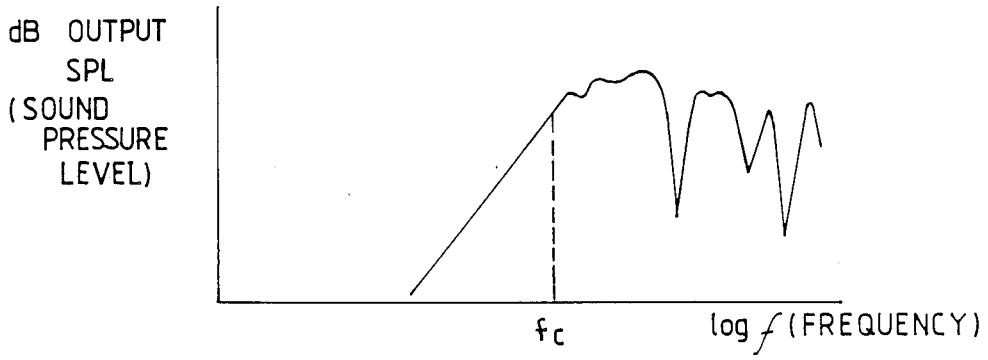
FIG. 2. PRIOR ART
FIG. 2 is a graph of sound pressure level against frequency illustrating a typical acoustic output characteristic of the shorted turn dome of the transducer shown in FIG. 1.

FIG. 2 shows a typical frequency response of the dome "tweeter" 11 with sound pressure level in decibels shown plotted against a logarithmic frequency scale. The cross-over frequency $f_c$ for the dome is shown in FIG. 2 and the ideal frequency response to the right of this would be substantially uniform and free from abrupt anomalies and irregularities. However, as can be seen from FIG. 2, there are various anomalies and irregularities in the frequency response above the crossover frequency, represented by peaks and dips in the frequency response. These are caused by various characteristics of the transducer. For instance, anomalies are caused by the dome radiating acoustic energy through a tube. Also, at the front end of the coil former tube 6, there is an acoustic impedance discontinuity where the profile of the horn-loading changes abruptly from cylindrical to conical.

FIG. 3 shows an electro acoustic transducer of a type similar to that shown in FIG. 1 but constituting a preferred embodiment of the invention. Like reference numerals refer to like parts and will not be described again.

The transducer of FIG. 3 includes a fixed member 14 in front of the dome 11. The fixed member 14 has a rearwardly extending integral shaft 15 which is fixed in a hole provided in an end face of the pole piece 4. The shaft passes through a hole in the dome 11 and the fixed member 14 is separated from the dome by a suspension 18. The suspensions 12 and 18 encircle the hole in the dome on both sides thereof to provide two small sealed chambers.

The coil former tube 6 is provided at its front edge with a flared extension 16 which, together with the former tube 6 and the fixed member 14, provides a smooth acoustic impedance transition and thus reduces or eliminates the acoustic impedance discontinuity at the front of the former tube 6.

In order to prevent electrical short circuits between the dome 11 and the pole piece 4, a layer of non-compliant electrically insulating material is provided therebetween. In the embodiment shown in FIG. 3, this layer 20 is provided on the inner surface of the dome 11. However, it could be provided on the pole piece 4 as well as or instead of on the dome 11.

Figure 4:
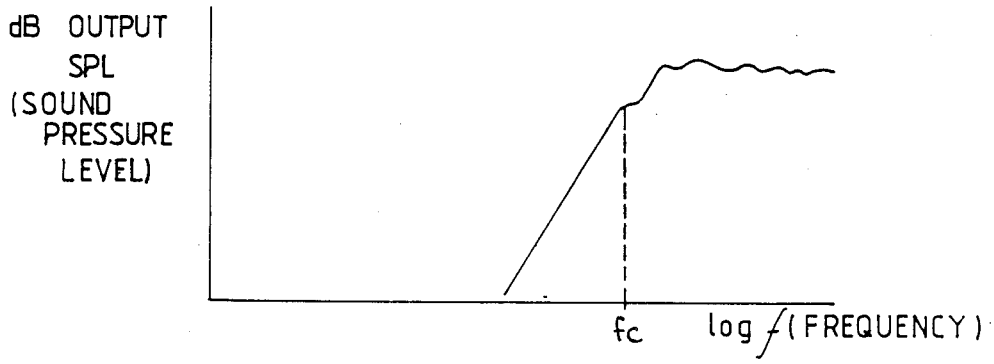
FIG. 4 is a graph of sound pressure level against frequency illustrating a typical acoustic output characteristic of the shorted turn dome of the transducer shown in FIG. 3.

FIG. 4 illustrates the frequency response of the dome 11 in FIG 3. Above the crossover frequency $f_c$, the frequency response is controllable and may be made to approach any desired output characteristic while being substantially free from significant irregularities and anomalies.

The fixed member 14 cooperates with the coil former tube 6 so as to provide phase correction and/or so as to provide horn loading in conjunction with the flared extension 16 and/or the cone 9. Depending on the specific configuration and dimensions chosen for the various parts of the transducer, the fixed member 14 and the former tube 6 may provide either one of these functions or both of these functions simultaneously. With or without the flared extension 16, this cooperation results in uniform, efficient, and controllable transfer of acoustic energy from the surface of the dome through the coil former tube.

Various parameters of the high frequency output of the dome can be controlled by choosing a suitable configuration of the fixed member 14, the former tube 6, and the flared extension 16 (when present) Thus, it is possible to control the frequency bandwidth, sensitivity, and directional characteristics as desired.

FIG. 5*a* shows the fixed member 14 of FIG. 3 in more detail and in relation to the coil former tube 6. The fixed member cooperates with the tube 6 to provide an annular passage for acoustic radiation from the dome 11, the cross sectional area of this passage increasing with distance from the dome. The tapering law may be chosen as desired by appropriate shaping of the fixed member. The position of the forwardmost point 21 of the fixed member 14 relative to the end of the tube 6 can be varied to be in front of or behind the position shown in FIG. 5*a* in order to adjust or vary the horn loading on the dome.

FIG. 5*b* shows an alternative form of fixed member 14 which provides two concentric tapering annular passages 22 and 23 for acoustic radiation from the dome.

FIG. 5*c* provides yet another form of fixed member 14 having several through-bores 24 which provide communication between the rear of fixed member 14 and a horn recess 25 at the front.

FIG. 5*d* shows a further form of fixed member 14 which differs from that shown in FIG. 5*a* in that several through-bores 30 pass through the fixed member 14 parallel to the axis of the transducer.

FIG. 5*e* shows another form of fixed member 14 which differs from that shown in FIG. 5*b* in that the tapering annular passage 22 is replaced by an annular passage 32 of constant cross-sectional area.

The configurations shown in FIGS. 5*a* to 5*e* are given purely by way of example, and many other configurations are possible. Although only symmetrical configurations have been shown, it is also possible to use non-symmetrical configurations. Also, configurations may be adopted in which the fixed member provides at least one annular passage having a portion of constant cross-sectional area and a tapering portion.

Although a concentric two-way drive unit has been described, another embodiment provides a single drive unit for high frequencies (a "tweeter"). In this embodiment, the coil is fixed and does not drive a radiating surface, but merely energises the shorted turn dome which provides the only radiating surface.

It is thus possible to provide an electro acoustic transducer of improved characteristics and in which various characteristics can be controlled or adjusted.

I claim:

1. An electro acoutic transducer comprising: a magnetic circuit including a first pole piece and a second pole piece defining therebetween a magnetic gap; a coil former; a coil for receiving electrical power for driving said transducer, said coil being wound on said coil former and being located at least partly in said magnetic gap; an acoustic radiating element having a skirt of electrically conductive material forming a shorted turn extending into said magnetic gap inside said coil, said acoustic radiating element being mechanically independent of said coil and said shorted turn being inductively coupled to said coil; and a fixed member located in front of said acoustic radiating element, said coil former extending forward of said acoustic radiating element and said fixed member being located at least partially within said coil former and having an end which faces said acoustic radiating element and which defines with said coil former an annular primary passage for exit of acoustic radiation generated by said acoustic radiating element.

2. A transducer as claimed in claim 1, in which said fixed member defines at least one through-bore extending from said end away from said acoustic radiating element and forming at least one secondary passage for exit of acoustic radiation generated by said acoustic radiating element.

3. A transducer as claimed in claim 1, in which said fixed member tapers inwardly from said end thereof and defines with said coil former a first horn extending from the primary passage.

4. A transducer as claimed in claim 3, in which said coil former has a flared extension forming a second horn.

5. A transducer as claimed in claim 4, including a further conical acoustic radiating element connected to said coil former.

6. A transducer as claimed in claim 1, in which said first pole piece extends inside said skirt and an electrically insulating layer is provided between said first pole piece and said acoustic radiating element.

7. A transducer as claimed in claim 6, including a first suspension attached to said first pole piece and a second suspension attached to said fixed member, said acoustic radiating element being suspended by and located between said first and second suspensions.

8. A transducer as claimed in claim 7, in which said acoustic radiating element is a dome defining a hole and said fixed member has a rearward extension passing through said hole and fixed to said first pole piece, each of said first and second suspensions comprising annular resilient means encircling said hole.

9. A transducer as claimed in claim 1, including a further conical acoustic radiating element connected to said coil former.

10. A transducer as claimed in claim 1, in which said fixed member defines an annular through-bore providing an annular secondary passage for exit of acoustic radiation generated by said acoustic radiating element.

11. A loudspeaker including a transducer as claimed in claim 1.

* * * * *